United States Patent [19]

Hollstein et al.

[11] Patent Number: 4,634,058

[45] Date of Patent: Jan. 6, 1987

[54] POWDER SPRAY GUN

[75] Inventors: Thomas E. Hollstein, Amherst; David E. O'Ryan, Avon Lake; Joseph C. Waryu, Amherst, all of Ohio

[73] Assignee: Nordson Corporation, Amherst, Ohio

[21] Appl. No.: 681,501

[22] Filed: Dec. 13, 1984

[51] Int. Cl.[4] ..... B05B 5/00

[52] U.S. Cl. ..... 239/697; 239/698; 239/707

[58] Field of Search ..... 239/697, 698, 704, 706, 239/707, 708

[56] References Cited

U.S. PATENT DOCUMENTS

| | | | |
|---|---|---|---|
| 3,503,650 | 3/1970 | Balmes, Sr. . | |
| 3,746,254 | 7/1973 | Duncan et al. . | |
| 3,870,375 | 3/1975 | Duncan et al. . | |
| 3,960,323 | 6/1976 | Duncan et al. . | |
| 4,037,561 | 7/1977 | LaFave et al. . | |
| 4,116,384 | 9/1978 | Lacchia . | |
| 4,169,560 | 10/1979 | Vöhringer | 239/609 |
| 4,258,409 | 3/1981 | Porter | 361/227 |
| 4,380,320 | 4/1983 | Hollstein et al. . | |

FOREIGN PATENT DOCUMENTS 2229206 11/1974 France .

OTHER PUBLICATIONS

Photographs of Nordson's Spray Gun #1.

*Primary Examiner*—Johnny D. Cherry
*Assistant Examiner*—Patrick N. Burkhart
*Attorney, Agent, or Firm*—Wood, Herron & Evans

[57] ABSTRACT

A powder spray gun for spraying solid particulate powder material wherein there is a venturi sleeve mounted internally of the gun barrel, within the rear of an extension tube, for increasing the velocity of powder conveyed therethrough and for generating turbulence in the powder so as to better dispense the powder throughout the powder pattern emitted from the gun.

4 Claims, 3 Drawing Figures

POWDER SPRAY GUN

This invention relates to powder spray equipment and, more particularly to an improved powder spray gun for applying solid particulate powder material to a target substrate.

In the application of solid particulate material, such as powdered paints, in industrial finishing applications, a powder material is commonly conveyed to a spray gun by air under pressure and is then dispensed from the gun in the form of a powder entrained air stream which is projected from the gun toward the object to be coated or painted. As the powder material is dispensed from the gun, the powder particles are quite often imparted with an electrical charge so that they may be electrostatically attracted toward the object to be coated which is held at electrical ground potential. After coating, the object or target substrate is generally moved into an oven where the powder coating material is heated and melted onto the target substrate.

In prior art electrostatic powder spray guns, a mechanical deflector is generally mounted at the nozzle end of the gun. The deflector extends into the flow path of powder being emitted from the gun and deflects the powder into a conical spray pattern. That is, the deflector is impacted by the powder coating material being emitted from the gun and directs the powder radially outwardly to form a conical spray pattern. It is critical to the even application of powder to the target substrate that the powder within the conical spray pattern be evenly distributed throughout the pattern. Heretofore, there has been a problem with powder being unevenly distributed throughout the pattern with the result that one side of the conical pattern becomes heavily loaded with powder while the other side applies a relatively light coating of powder. Another problem heretofore characteristic of powder spray guns is that of powder collecting on parts of the gun internally of the gun and requiring very time consuming disassembly and cleaning of the gun components.

In an attempt to solve the problem of uneven distribution of powder throughout the powder spray pattern of a powder spray gun, it has been proposed to add a lance extension to the barrel of the gun and then to locate a venturi sleeve within that lance extension. The venturi sleeve is located within the rear one-third of the lance extension and functions there to increase the velocity of powder flowing through the extension and then to provide an abrupt opening wherein turbulence is created in the powder flow stream to better distribute the powder throughout the stream before it is subsequently transported to and through a nozzle at the end of the lance extension. Such a lance extension powder spray gun is part of the prior art and is disclosed in U.S. patent application Ser. No. 638,391 of R. M. Fetchenko, et al for "Lance Extension Venturi Sleeve", assigned to the assignee of this application.

A problem characteristic of the lance extension powder spray gun described hereinabove is that it is very long, unbalanced and unwieldly relative to a powder spray gun which does not incorporate a lance extension. It has therefore been a principal objective of this invention to provide an improved powder spray gun which achieves an even or homogeneous distribution of powder throughout a powder spray pattern without the need to add a lance extension to the powder spray gun. This objective is in part achieved by providing a relatively long powder flow passage in the barrel of the gun and a venturi sleeve construction in that passage. The venturi sleeve has the effect of thoroughly mixing the powder in the air stream within the gun so as to provide a greater homogeneity of powder throughout the powder pattern emitted from the gun.

To minimize the time consumed in disassembly and cleaning of the gun components whenever the gun becomes clogged with powder, the powder gun of this invention is assembled with all of the components which are exposed to powder flow assembled by a sliding fit and secured in an assembled relationship solely by means of resilient O-rings. As a consequence, the components may be easily disassembled and reassembled by simply sliding the components apart without any requirement of handling loose connectors, screws, nuts, bolts, etc. This assembly technique also permits easy adjustment of a pattern adjusting sleeve located at the forward end of the gun surrounding the deflector.

The powder spray gun of this invention which achieves these objectives comprises a barrel having a high voltage electrical transmission flow path therein and a powder flow opening at the forward end thereof. The rearward end of this opening is intersected by a powder flow passage through which air entrained powder is supplied to the gun. This passage is spaced a substantial distance from the nozzle of the gun so as to provide a relatively long powder flow path through the opening in the barrel to the nozzle. Mounted within this opening there is an extension tube, the forward end of which extends beyond the forward end of the barrel. An adjuster sleeve is slideably mounted over the forward end of the extension tube and an electrode support is mounted internally of the adjuster sleeve. A horn shaped deflector is mounted on the forward end of the electrode support and a powder charging electrode extends from the forward end of the electrode support. Internally of the electrode support there is a resistor which is connected to the high voltage electrical flow path within the barrel of the gun.

A venturi sleeve is mounted in the rear or upstream end of the extension tube internally of the barrel of the gun near the point at which powder enters the barrel. This venturi sleeve has a constriction therein operable to increase the velocity of air entrained powder passing therethrough. The constriction terminates in an abrupt end wall of the sleeve opening into a substantially larger volume flow passage operable to create turbulence in the powder flow. The effect of this turbulence is to increase the homogeneity or even distribution of powder in the powder spray pattern emitted from the gun.

The gun barrel, the extension tube, the venturi sleeve, the adjuster sleeve, and the electrode support of the powder spray gun of this invention all slide together and are secured in an assembled relationship solely by means of resilient O-rings. As a result, all of the components of the gun which are subject to becoming coated with powder may be easily disassembled and assembled without the need for any loose connectors or other components. As a result, the gun may be very quickly cleaned if it should become clogged with powder and there is no chance to lose small connecting parts required for the assembly of the gun barrel.

These and other objects and advantages of this invention will be more readily apparent from the following description of the drawings in which.

Figures 1, 2, 3:
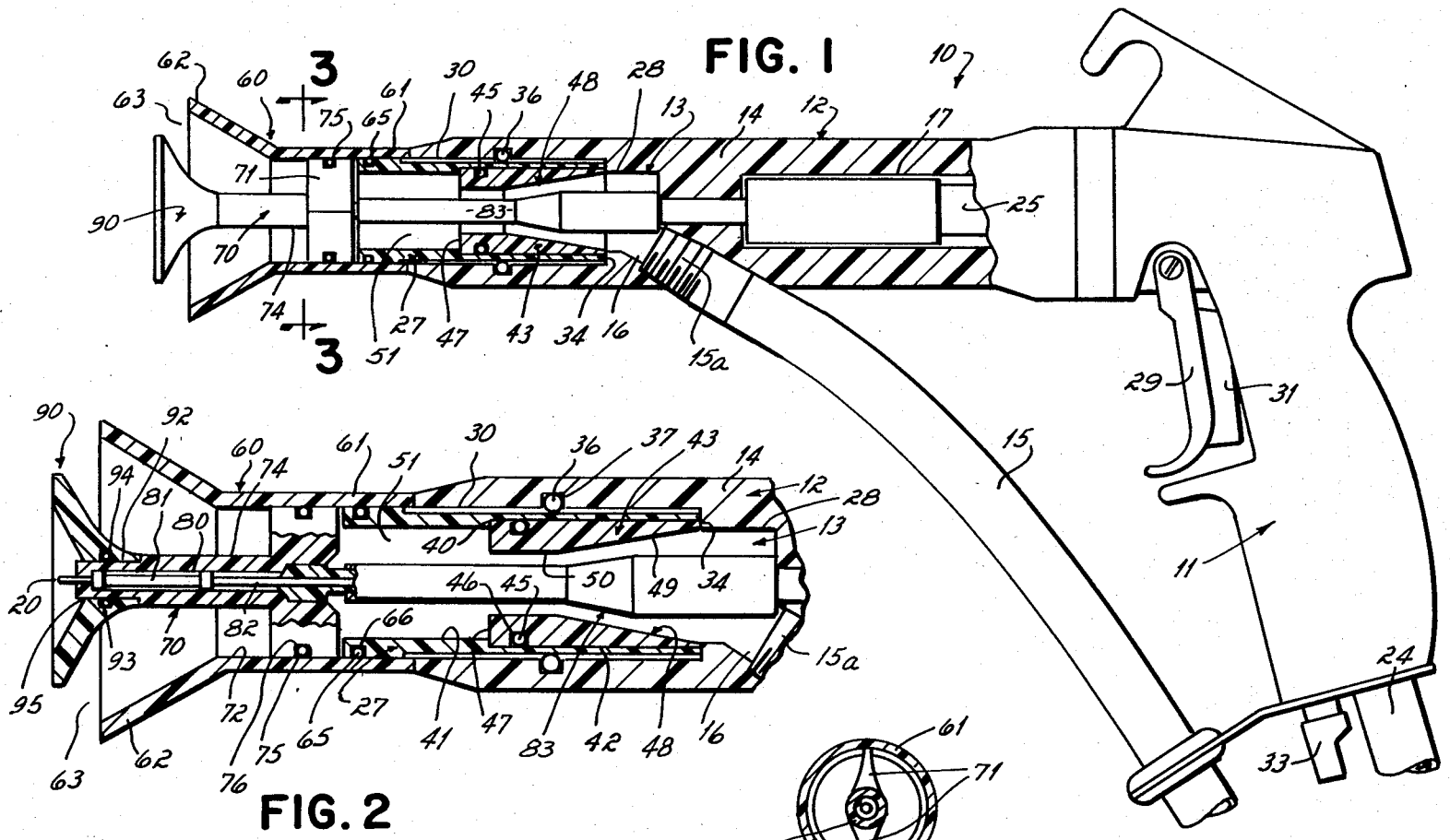
FIG. 1 is a side elevational view, partially broken away, of a powder spray gun incorporating the invention of this application.
FIG. 2 is an enlarged cross-sectional view of the nozzle portion of the gun of FIG. 1.
FIG. 3 is a cross-sectional view taken on line 3—3 of FIG. 1.

With reference to FIG. 1, it will be seen that the gun 10 of this invention comprises an electrically grounded metal handle assembly 11 and an electrically insulative barrel assembly 12 mounted upon the forward end of the handle 11. The barrel assembly 12 includes a barrel 14, the forward end of which is provided with an opening 13. Air entrained powder material is supplied to this opening 13 under pressure from an external source (not shown) via a hose 15. The hose 15 is connected to a fitting 15*a* mounted in an opening 16 through the wall of the barrel 14 of the gun. The barrel assembly 12 also includes an axial passageway 17 which extends from the opening 13 to the rear of the barrel and communicates with a passage (not shown) in the barrel through which electrical power is applied to an electrode 20 mounted in the front of the gun.

The handle assembly 11 is made from a metal casting, for example, aluminum, and is electrically grounded. A high voltage source of electrical energy is supplied to the gun 10 by the cable 24 from an external power pack (not shown). The voltage supplied to the gun is typically in the range of 30 kv to 90 kv. The high voltage cable 24 connects into the butt of the handle 11 and continues through the handle 11 into the axial passage 17 of the barrel 12. The cable 24 terminates in the barrel in an electrically conductive connector (not shown) contained within an insulation tube 25. The electrically conductive connector contained within the tube 25 includes an electrically conductive spring which biases the conductor into electrical contact with a resistor (not shown) located in the electrical flow path between the end of the cable 24 and the electrode 20 as is conventional in electrostatic spray guns.

The handle 11 includes a trigger 29 to which is mounted a magnet 31. When the trigger is squeezed, the magnet 31 triggers a proximity switch and connector assembly 33 which extends out of the butt of the handle 11 and connects to a cable to operate controls which turn on and off the electrical power to the gun, and the air supply to the powder pump for fluidizing the powder and for conveying it to the gun through the hose 15.

The powder flow opening 13 in the front of the barrel comprises a stepped bore having a large diameter section 30 at the front of the opening and a smaller diameter section 28 which is intersected by the powder flow passage 16. The larger diameter section 30 has an extension tube 27 mounted therein. The outside diameter of this tube is slightly smaller in diameter than the inside diameter of the section 30 of the opening 13 so that the extension tube may be assembled by simply sliding the extension tube into the section 30 of the bore until the rear end 34 of the tube 27 abuts the shoulder defined between the two different diameter sections 30, 28 of the opening 13. The extension tube is retained in and secured within the powder flow opening by a resilient silicone O-ring contained within an annular groove 37 formed in the barrel 14.

The internal diameter bore of the extension tube 27 is stepped so as to provide a shoulder 40 between the two different diameter sections 41, 42. Mounted in the larger diameter section 42 is a venturi sleeve 43, the outside diameter of which is just slightly smaller than the inside diameter of the bore 42. The venturi sleeve 43 and extension tube 27 are secured in an assembled relationship by another resilient silicone O-ring 45 mounted within an annular groove 46 in the periphery of the venturi sleeve 43.

An axial bore 48 extends through the venturi sleeve and defines in part the powder flow passageway through the barrel of the gun. This bore comprises a tapered section 49 at the rear of the sleeve and a cylindrical section 50 at the front. The tapered section 49 of the bore 48 tapers inwardly and forwardly from a large diameter opening at the rear of the sleeve to the smaller diameter cylindrical section 50. The cylindrical section of the bore thus acts as a constriction in the powder flow passage through the gun barrel. This constriction opens abruptly at the forward end wall 47 of the sleeve 43 into a large diameter chamber 51 contained within the forward end of the extension 27. The function of the venturi sleeve is to increase the velocity of air entrained powder passing through the barrel and to create turbulence in that powder when it abruptly enters the larger volume chamber 51. This turbulence in turn causes the powder entering the forward end of the barrel to be homogeneously mixed with the air in which it is entrained so that the powder emerging from the gun contains an even distribution of powder throughout.

An adjuster sleeve 60 is slideably mounted over the forward end of the extension tube 27. This sleeve comprises a cylindrical rear section 61 and a generally bell-shaped forward section 62. This bell-shaped forward section 62 tapers outwardly and forwardly from the forward end of the cylindrical section 61 so as to define an outwardly and forwardly tapered opening 63 at the forward end of the adjuster sleeve.

The adjuster sleeve 60 is secured onto the forward end of the extension tube by a resilient "Viton" O-ring 65 contained within an annular groove 66 in the periphery of the extension tube 33. This mounting of the adjuster sleeve onto the extension tube enables the adjuster sleeve to be adjusted longitudinally on the extension tube by simply sliding it forwardly away from the forward end of the barrel 14.

Mounted within the adjuster sleeve 60 there is an electrode support 70. This support comprises a transverse bar section 71 which extends diametrically across the bore 72 of the cylindrical section 61 of the adjuster sleeve and an axial post section 74 which extends forwardly from the transverse bar 71 section. The electrode support 70 is slideable within the adjustor sleeve and is secured in an assembled relationship relative thereto by another resilient "Viton" O-ring seal 75 mounted within a groove 76 in the outer ends of the transverse bar section 71 of the support 70.

The electrode support has an axial bore 80 extending therethrough. The electrode 20 extends forwardly beyond the forward end of the axial post section 74 of the support and is in electrical contact with a resistor 81 contained in the forward end of the electrode support. This resistor is in turn connected via an electrical power transmission connector 82 contained within the electrode support to an electrical power transmission connector assembly 83 which in turn electrically connects the connector 82 to the end contact (not shown) of the electrical cable 24. Presently, connector 82 is a resistive material such as a continuous silicon carbide fiber supplied under the name NICALON by Nippon Carbon Co., Ltd. of Tokyo, Japan. As a consequence of the electrical connection of the electrode 20 through the resistor 81, contact 82, and electrical connector assembly 83, power may be transmitted under the control of the trigger 29 through the cable 24 to the electrode 20.

Mounted on the forward end of the electrode support post 74, there is a deflector 90. This deflector is slideable over a smaller diameter end section 92 of the forward end of the post 74 and is secured thereon by a resilient O-ring 93 contained within an annular groove 94 in the bore 95 of the deflector 90.

In the use of the gun illustrated in FIGS. 1–3, actuation of the trigger 29 causes electrical power to be transmitted through the electrical cable 24 to the electrode 20 while simultaneously air entrained powder is transmitted under pressure through the tube 15 to the powder supply passage 16 in the barrel. The air entrained powder is transported through this passage 16 into the rear of the opening 13 in the forward end of the barrel 14. This air entrained powder, upon entering the opening 13, is forced to flow through the constriction contained within the venturi sleeve 43 so as to impart a relatively high velocity to the powder. Upon emerging from the restriction in the venturi sleeve, the powder abruptly enters the relatively large mixing chamber 51 contained in the extension tube 27 and defined in part by the flat end wall 47 of the venturi sleeve. The mixing chamber 51 is of substantially greater cross-sectional area than the cross-section of the constriction contained in the venturi sleeve 43 so that upon entering this chamber, a great deal of turbulence is created in the air/powder mixture. As a result, the powder is thoroughly and evenly dispersed before emerging from the gun through the annular channel defined between the peripheral surface of the deflector 90 and the internal bore of the adjuster sleeve 60.

One of the primary advantages of the gun depicted herein is that the effective length of the barrel may be changed by simply replacing the extension tube 27 with another of greater or lesser length. In this way, the proximity of the nozzle end of the gun from a workpiece may be varied or changed without moving the gun relative to a workpiece. It is also to be noted that the gun may be easily and quickly disassembled for cleaning if it should become clogged with powder. All that is required is to simply pull apart all of the powder contacting components of the barrel without the need for any tools to effect the disassembly. Similarly, the gun may be easily reassembled by simply pushing the parts together. This quick disassembly and reassembly without the need for any tools is attributable to the component parts of the barrel assembly all being secured in an assembled relationship by O-rings 36, 45, 65, 75 and 93 contained in the annular channels of the component parts.

While we have described only a single preferred embodiment of our invention, persons skilled in this art will appreciate changes and modifications which may be made without departing from the spirit of our invention. Therefore, we do not intend to be limited except by the scope of the following appended claims:

We claim:

1. A powder spray gun for spraying solid particulate powder material comprising a barrel having a longitudinally extending opening at its forward end, said opening extending from the forward end of said barrel to a point located approximately medially of the length of said barrel, a passage through the wall of said barrel communicating with the rear of the opening near the midpoint in the length of the barrel, said passage being adapted to be connected to a source of air entrained powder material, an extension tube mounted in said barrel opening, said extension tube having a forward end extending out of and forward of the forward end of said barrel, a venturi sleeve mounted within the rear of said extension tube, said venturi sleeve including a rear end and a forward end, the rear end of said venturi sleeve being located immediately adjacent said passage in the wall of said barrel, said venturi sleeve having a bore extending therethrough, said bore having a rearwardly opening tapered section and a forward open section of reduced diameter operatively connected to said tapered section for increasing the velocity of powder conveyed therethrough, and the forward section of said bore opening abruptly rearwardly of said forward end of said barrel into a relatively large chamber within said extension tube for generating turbulence in said powder within said extension tube.

2. The powder spray gun of claim 1 which further includes an adjuster sleeve mounted over said forward end of said extension tube, the forward end of said adjuster sleeve having an outwardly and forwardly tapered powder discharge opening, deflector supporting means mounted within said adjuster sleeve, and a deflector mounted upon the forward end of said deflector supporting means, said deflector having a generally horn-shaped peripheral surface extending generally parallel to but spaced inwardly from said outwardly and forwardly tapered opening in said adjuster sleeve.

3. The powder spray gun of claim 2 in which said barrel, extension tube, venturi sleeve, adjuster sleeve, and deflector supporting means are all secured together in an assembled relationship solely by resilient O-ring seals.

4. The powder spray gun of claim 2 which further includes a high voltage electrical transmission means mounted within said barrel and adapted to be connected to a source of high voltage electrical power, an electrode extending forwardly from the forward end of said deflector, the rear end of said electrode being electrically connected to said high voltage electrical transmission means.

* * * * *